United States Patent [19]

Ullman

[11] Patent Number: 4,459,648

[45] Date of Patent: Jul. 10, 1984

[54] RECESSED LIGHTING FIXTURE AND LAMP MOUNT THEREFOR

[76] Inventor: Allan Ullman, 22 Highland Ave., Sea Cliff, N.Y. 11579

[21] Appl. No.: 514,448

[22] Filed: Jul. 18, 1983

[51] Int. Cl.[3] ..... F21V 7/00; H01R 33/00

[52] U.S. Cl. ..... 362/307; 339/176 L; 362/147; 362/226; 362/267; 362/365; 362/370; 362/396; 362/404

[58] Field of Search ..... 362/226, 364, 370, 453, 362/454, 267, 408; 339/167, 176 L, 154 L, 177 L, 178, 179, 180, 155 L; 315/276

[56] References Cited

U.S. PATENT DOCUMENTS

| | | | |
|---|---|---|---|
| 1,296,433 | 3/1919 | Schafer et al. | 362/453 |
| 2,012,419 | 8/1935 | Daniels | 315/276 |
| 3,097,800 | 7/1963 | Schwartz | 362/226 |
| 3,233,088 | 2/1966 | McDonald | 362/364 X |
| 3,248,534 | 4/1966 | Cahill et al. | 339/154 L |
| 3,871,732 | 3/1975 | Appleton | 339/176 L X |
| 3,878,390 | 4/1975 | Feder | 339/176 L X |
| 3,883,732 | 5/1975 | Peterson et al. | 362/264 X |

*Primary Examiner*—Donald G. Kelly
*Assistant Examiner*—John S. Maples
*Attorney, Agent, or Firm*—Eugene E. Geoffrey, Jr.

[57] ABSTRACT

A lighting fixture and lamp mount therefor for use with lamps having prong-type connectors projecting from the back or side of the lamps which includes a lamp housing, a socket carried by the housing and a lamp carrier, the lamp carrier having a threaded connector connected to the lamp so that the lamp and lamp carrier can be screwed into the socket to energize the lamp and can be readily removed for lamp replacement.

9 Claims, 3 Drawing Figures

RECESSED LIGHTING FIXTURE AND LAMP MOUNT THEREFOR

This invention relates to lighting fixtures and more specifically to a lighting fixture including a lamp mount therefor to enable the utilization of lamps having prong-type connectors and at the same time facilitate replacement even when used in elevated positions which may not be readily accessible.

A wide variety of internal reflector, spot and flood lamps are provided with prong-type connectors for both indoor and outdoor use. Such lamps are made for operation on normal line voltages such as 120 volts and on low voltage lines such as 6, 12 or 24 volts. In the latter case, transformers are generally used to enable operation on normal line voltages. When lighting fixtures embodying lamps having prong-type connectors are used at elevated positions such as high ceilings and the like, lamp replacement is difficult as appropriate ladders are required to gain direct access to the fixture in order to replace the lamp. Another difficulty encountered with low voltage lamps is that an individual transformer is required which has been mounted on each lamp support and since the transformer has been located in close proximity to the lamp, the associated lamp housing had to provide for adequate cooling or in the alternative the transformer had to be designed for the high operating temperatures produced both by the transformer itself and the heat radiated by the lamp. Such an arrangement involves materially increased cost either for the provision of adequate ventillation or a high temperature transformer.

This invention overcomes the foregoing difficulties and provides a novel and improved lighting fixture embodying a lamp having a prong-type connector that is characterized by its simplicity, relatively low cost and ease of maintenance.

Another object of the invention resides in the provision of a novel and improved lighting fixture embodying a low voltage lamp wherein the transformer is mounted externally of and carried by the lighting fixture housing so that the housing need only be provided for adequate ventillation for the lamp which avoids the need for a costly high temperature transformer.

The foregoing objects are attained by an improved arrangement and organization of elements wherein the lighting fixture is provided with a housing which includes a screw-type socket of the type used for conventional scew-base lamps. The lamp with the prong-type connector is carried by an independent support which also includes a screw base for engagement with the socket carried by the fixture housing. With the foregoing arrangement, lamps can be easily replaced and in the case of low voltage lamps, the housing need only provide adequate means for dissipating heat from the lamp as the transformer is disposed in a protected position externally of the lamp housing.

The above and other objects and advantages will become more apparent from the following description and accompanying drawings forming part of this application.

IN THE DRAWINGS

Figure 1:
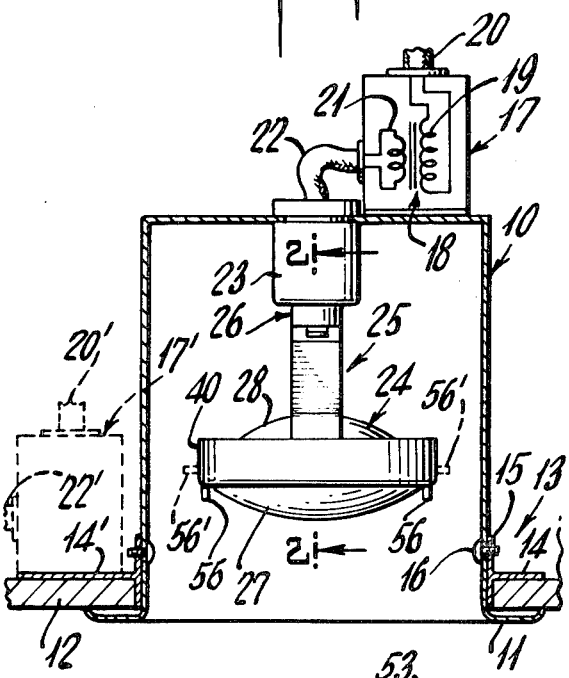
FIG. 1 is an elevational view in partial section of a lighting fixture in accordance with the invention.

The form of the invention shown in the drawings and now to be described involves a low voltage lamp with a prong-type connector and an externally mounted transformer. It will be apparent however that when using a high voltage lamp of the order of 120 volts, the transformer would not be required.

Referring now to the drawings and more specifically to FIG. 1, the lighting fixture in accordance with the illustrated embodiment of the invention comprises an outer housing 10 which is in the form of a recessed high-hat having an outwardly extending peripheral flange 11 underlying the edge of an opening in the ceiling 12. The housing 10 is held in position in the ceiling by a mounting bracket generally denoted by the numeral 13 which includes an annular ring-like member 14 surrounding the fixture and lying against the upper surface of the ceiling 12. A plurality of vertically disposed brackets which normally would involve three brackets denoted by the numeral 15 are welded or otherwise secured to the inner edge of the ring 14. Each bracket 15 includes a threaded opening for accommodating a cooperating screw 16 which extends through an opening in the housing 10 and engages a bracket 15. When using the illustrated low voltage lamp, a smaller housing 17 is mounted on top of the fixture housing 10 and includes a transformer illustrated symbolically and denoted by the numeral 18. The transformer has a primary winding 19 which is connected to an insulated cable 20 for connection to a 120-volt circuit and a low voltage winding 21 for connection through a cable 22 to a conventional screw-type socket such as a so-called standard socket 23. A low voltage lamp 24 and support therefor which is generally denoted by the numeral 25 carries a cooperating threaded male connector 26 for engagement with the socket 23 so that the assembly consisting of the lamp 24, lamp support 25 and male connector 26 can be readily removed from the fixture housing 10 for replacement of the lamp 24. The lamp 24 and supporting structure 25 are shown more clearly in FIGS. 2 and 3.

Figure 3:
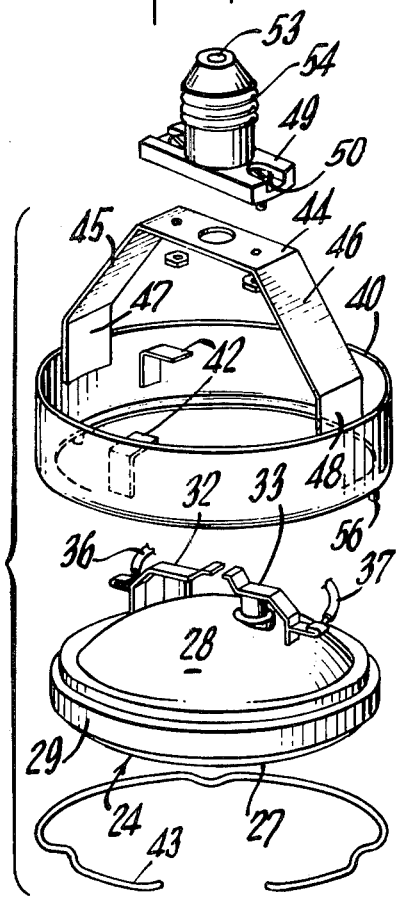
FIG. 3 is an exploded perspective view of the lamp and support therefor of FIG. 2.
Figure 2:
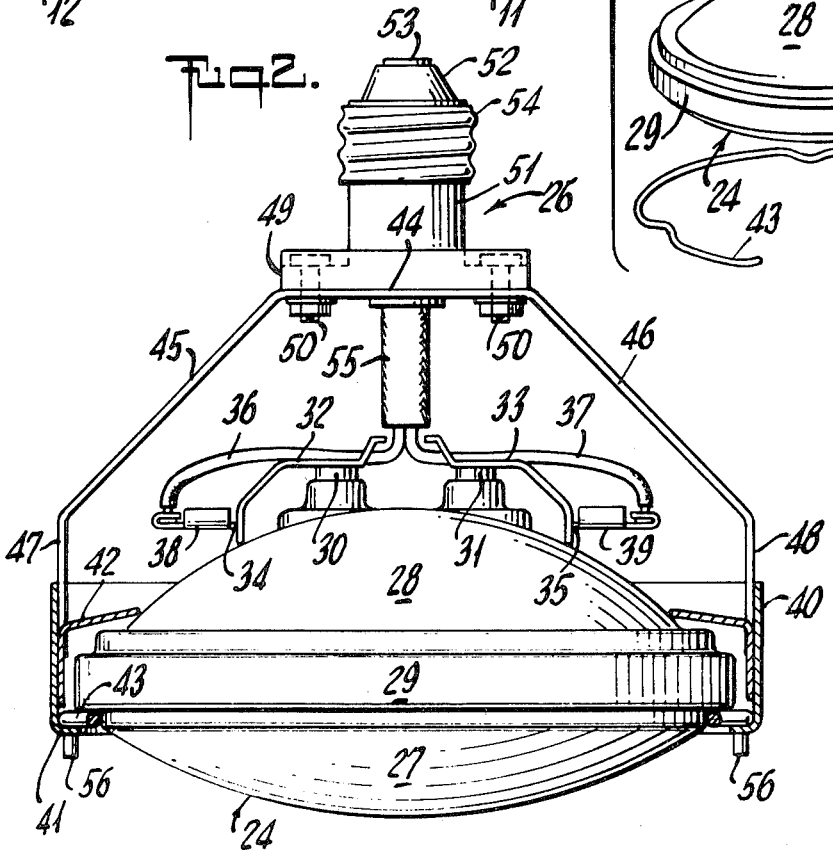
FIG. 2 is an enlarged elevational view in partial section of the lamp and support therefor in accordance with the invention.

Referring now to FIGS. 2 and 3, the lamp 24 is generally formed of glass with a lens 27 on one side thereof and a rear closure portion 28 having a reflecting surface on the inner surface thereof. A lamp mounting ring 29 is disposed between the front and rear lamp elements 27 and 28 to facilitate mounting of the lamp. The lamp filament not shown, is connected to terminals 30 and 31 having outwardly extending brackets 32 and 33 which include spade-type terminals 34 and 35 to which wires 36 and 37 from the threaded connector are attached by means of cooperating connectors 38 and 39. In other instances, the lamp may have parallel prongs for receipt of a conventional connector.

The supporting structure for the lamp 24 includes an annular member having an upwardly extending wall 40 and a narrow inwardly extending flange 41 on the lower edge thereof. The upwardly extending wall carries three L-shaped brackets 42 spot-welded or otherwise secured to the upwardly extending wall 40 with one leg extending inwardly for engagement with the back portion 28 of the lamp 24. An annular spring 43 surrounds the lamp and engages both the inwardly extending flange 41 and the underside of the mounting ring 29 surrounding the lamp to hold the lamp firmly in position within the annular member comprising the elements 40 and 41.

A generally U-shaped bracket having a top portion 44, outwardly inclined sides 45 and 46 and vertically disposed end portions 47 and 48 is secured to the annular ring 40 by spot-welding or otherwise securing the legs 47 and 48 to the inner surface of the ring 40 as illustrated more clearly in FIG. 3. The upper portion of the bracket 44 supports a threaded connector 26. In this embodiment of the invention, the threaded connector 26 includes a flat base 49 having spaced openings to receive screws 50 for holding the connector to the top wall. A centrally disposed cylindrical element also of insulating material 51 terminates in a truncated cone 52 carrying an electrical contact 53. A threaded element 54 of conductive material surrounds and is secured to the cylindrical member 51. The lead wires 36 and 37 extend upwardly through a piece of tubing 55 of insulating material through the top portion 44 of the generally U-shaped bracket and one of the lead wires 36 for instance is connected to the terminal 53 while the other lead wire 37 for instance is connected to the threaded element 54. With this arrangement, the lamp support 25 and cooperating threaded connector 26 can be merely screwed into the socket 23 and can be readily removed for replacement of the lamp by removal of the spring ring 43 and the connectors 38 and 39. Upon replacement of the lamp, the assembly can then be screwed into place within the fixture. When using a high voltage lamp not requiring a transformer and having parallel prongs extending therefrom, the wires 36 and 37 are merely attached to a female connector designed for slidable engagement with the prongs.

To facilitate removal of the lamp and the associated assembly 25, the inwardly extending flange on the vertically disposed wall 40 surrounding the lamp may carry two or more posts 56 for engagement by a suitable lamp removing device which would also include a suction cup to avoid the need for utilization of a ladder in instances where the lamps may be installed on very high ceilings. If desired, the posts 56' shown in broken outline and positioned on the side of the ring 40 may be used in place of the posts 56.

As described above, the transformer 18 and housing 17 was mounted on top of the fixture housing 10. If desired, the transformer and housing may be mounted on the mounting bracket 13 in which case at least a portion 14' of the ring 14 would be widened to accommodate the transformer and housing therefore shown in broken outline and denoted generally by the numeral 17'. The cables 20' and 22' would then be connected to a power source and the lamp socket 23 respectively.

While the invention has been described in connection with a recessed lighting fixture, it is evident that it may be utilized with other types of fixtures such as fixtures which are surface mounted, wall mounted or pendant.

While only certain embodiments of the invention have been illustrated and described, it is to be understood that alterations, changes and modifications may be made without departing from the true scope and spirit of the invention.

What is claimed is:

1. A lighting fixture and lamp mount therefor comprising a lamp housing, a screw-type socket carried by said housing for connection to a source of energy, a lamp having prongs extending therefrom, a lamp mount including means for securing said lamp to said mount, a screw-base electrical connector carried by said mount for cooperating with said socket and connections between said connector and said lamp prongs whereupon engagement of said electrical connector with said socket functions to support said lamp and lamp mount within said housing and connect said lamp to said source of energy, said lamp mount including a wall conforming to the peripheral configuration of said lamp, inwardly extending flange means on one edge of said wall, inwardly extending lamp retaining means adjoining the other edge of said wall, means engaging said lamp and flange means to retain said lamp in position within said wall and against said lamp retaining means, a U-shaped member having downwardly extending legs secured to said wall and a top portion carrying said electrical connector in spaced relationship to said lamp.

2. A lighting fixture and lamp mount therefor according to claim 1 wherein said socket includes a center contact and a threaded cylindrical member of conductive material surrounding said center contact and said electrical connector includes a threaded cylindrical member of conductive material for threadably engaging said socket and a central contact for engaging said center contact.

3. A lighting fixture and lamp mount therefor according to claim 2 wherein said lamp is circular in configuration with a light transmitting lens on one side thereof, a rear wall sealed to said lens and having a reflector on the inside thereof, said prongs extending from said rear wall.

4. A lighting fixture and lamp mount therefor according to claim 2 wherein said wall carries at least two pins extending outwardly thereof for engagement by lamp removal means to facilitate removal of said lamp and lamp mount from said lamp housing for maintenance and removal of said lamp.

5. A lighting fixture and lamp mount therefor according to claim 1 wherein said lamp is a low voltage lamp, and includes a transformer positioned externally of said housing, said transformer having a high voltage primary winding connected to said source of energy and a low voltage winding connected to said socket.

6. A lighting fixture and lamp mount therefor according to claim 5 wherein said lamp is circular in configuration with a light transmitting lens on one side thereof, a rear wall sealed to said lens and having a reflector on the inside thereof, said prongs extending from said rear wall.

7. A lighting fixture and lamp mount therefor according to claim 5 wherein said wall carries at least two pins extending outwardly thereof for engagement by lamp removal means to facilitate removal of said lamp and lamp mount from said lamp housing for maintenance and removal of said lamp.

8. A lighting fixture and lamp mount therefor according to claim 7 wherein said transformer is secured to said lamp housing.

9. A lighting fixture and lamp mount therefor according to claim 7 including a light fixture mount for securing said fixture to a support and said transformer is secured to said mount.

* * * * *